US007365711B2

(12) United States Patent
Kim

(10) Patent No.: US 7,365,711 B2
(45) Date of Patent: Apr. 29, 2008

(54) DRIVING APPARATUS OF PLASMA DISPLAY PANEL AND METHOD FOR DISPLAYING PICTURES ON PLASMA DISPLAY PANEL

(75) Inventor: Se-Woong Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 606 days.

(21) Appl. No.: 10/948,658

(22) Filed: Sep. 24, 2004

(65) Prior Publication Data

US 2005/0073484 A1 Apr. 7, 2005

(30) Foreign Application Priority Data

Oct. 1, 2003 (KR) ..... 10-2003-0068394

(51) Int. Cl.
*G09G 3/28* (2006.01)

(52) U.S. Cl. ..... 345/60; 345/63; 345/67; 345/68; 345/66

(58) Field of Classification Search ..... 345/60, 345/63, 606, 204, 693, 690, 691, 68, 32, 345/419, 596, 616, 173, 473, 66, 67, 88; 348/E5.133, E5.73, 74, 51
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.

(Continued)

FOREIGN PATENT DOCUMENTS

JP 02-148645 6/1990

(Continued)

OTHER PUBLICATIONS

"*Final Draft International Standard*", Project No. 47C/61988-1-Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Prabodh Dharia
(74) *Attorney, Agent, or Firm*—Robert E. Bushnell, Esq.

(57) ABSTRACT

A plasma display panel (PDP) driving apparatus and a method for displaying pictures on the PDP increases the ability to express low gray scales without increasing the number of sub-fields. Input picture signal data are delayed by one frame and the number of high-order bits, from most significant bits not commonly used by all picture signal data within one frame, is detected. When the number of unused bits is detected, inverse gamma-corrected decimal point bits are shifted to an actual data position by the number of unused bits so as to increase power of expression of low gray scale. The decimal point bits are converted into sub-fields having low gray scale weights, in consideration of the shifting to the actual data position, for display on the PDP.

16 Claims, 6 Drawing Sheets

U.S. PATENT DOCUMENTS

| | | | | |
|---|---|---|---|---|
| 5,923,320 | A * | 7/1999 | Murakami et al. | 345/179 |
| 5,952,782 | A | 9/1999 | Nanto | |
| 6,069,609 | A * | 5/2000 | Ishida et al. | 345/596 |
| RE37,444 | E | 11/2001 | Kanazawa | |
| 6,429,833 | B1 * | 8/2002 | Ryeom et al. | 345/63 |
| 6,630,916 | B1 | 10/2003 | Shinoda | |
| 6,707,436 | B2 | 3/2004 | Setoguchi et al. | |
| 6,791,516 | B2 * | 9/2004 | Kang | 345/63 |
| 7,098,874 | B2 * | 8/2006 | Kang et al. | 345/60 |
| 7,239,295 | B2 * | 7/2007 | Kang et al. | 345/63 |
| 2002/0186225 | A1 * | 12/2002 | Hsu et al. | 345/606 |
| 2003/0063049 | A1 * | 4/2003 | Eo et al. | 345/60 |
| 2003/0122736 | A1 * | 7/2003 | Kang et al. | 345/60 |
| 2006/0284899 | A1 * | 12/2006 | Kimura | 345/690 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |
| KR | 10-2002-14766 | 2/2002 |

* cited by examiner

*FIG. 7A*

Maximal picture input value : 63 (00111111.XXXX)

| SF1 | SF1 | SF2 | SF3 | SF4 | SF5 | SF6 | SF7 | SF8 |
|---|---|---|---|---|---|---|---|---|
| ON/OFF | ON | ON | ON | ON | ON | ON | OFF | OFF |
| Weight | 1 | 2 | 4 | 8 | 16 | 32 | 64 | 128 |

unused bits

*FIG. 7B*

Error diffused

Picture input value : 63 (111111XX.XX)

| SF1 | SF1 | SF2 | SF3 | SF4 | SF5 | SF6 | SF7 | SF8 |
|---|---|---|---|---|---|---|---|---|
| ON/OFF | ON | ON | ON | ON | ON | ON | ON | ON |
| Weight | 0.25 | 0.5 | 1 | 2 | 4 | 8 | 16 | 32 |

*FIG. 7C*

Error diffused

Picture input value : 63 (11111XX.XX)

| SF1 | SF1 | SF2 | SF3 | SF4 | SF5 | SF6 | SF7 | SF8 |
|---|---|---|---|---|---|---|---|---|
| ON/OFF | ON | ON | ON | ON | ON | ON | ON | ON |
| Weight | 1 | 2 | 4 | 8 | 16 | 32 | 0.25 | 0.5 |

DRIVING APPARATUS OF PLASMA DISPLAY PANEL AND METHOD FOR DISPLAYING PICTURES ON PLASMA DISPLAY PANEL

CLAIM OF PRIORITY

This application makes reference to, incorporates the same herein, and claims all benefits accruing under 35 U.S.C. §119 from an application for DRIVING APPARATUS OF PLASMA DISPLAY PANEL AND METHOD FOR DISPLAYING PICTURES ON PLASMA DISPLAY PANEL earlier filed in the Korean Intellectual Property Office on 1 Oct. 2003 and there duly assigned Serial No. 2003-68394.

BACKGROUND OF THE INVENTION

1. Technical Field

The present invention relates to a driving apparatus of a plasma display panel (PDP) and a method for displaying pictures on the plasma display panel and, more particularly, to a driving apparatus of a plasma display panel (PDP) and a method for displaying pictures on the plasma display panel with increased ability to express a low gray scale.

2. Related Art

Recently, flat panel displays, such as liquid crystal displays (LCDs), field emission displays (FEDs) and PDPs, have been actively developed. The PDPs are advantageous over the other flat panel displays with respect to their high luminance, high luminous efficiency and wide viewing angle. Accordingly, the PDPs are being highlighted as a substitute for conventional cathode ray tubes (CRTs) for large-screen displays of more than 40 inches in size.

The PDPs are flat panel displays that use plasma generated by gas discharge to display characters or images. The PDPs include, according to their size, more than several tens to millions of pixels arranged in the form of a matrix. These PDPs are classified into a direct current (DC) type and an alternating current (AC) type according to patterns of waveforms of driving voltages applied thereto and discharge cell structures thereof.

The direct current plasma display panel (DC PDP) has electrodes exposed to a discharge space, thereby causing current to directly flow through the discharge space during application of a voltage to the DC PDP. In this connection, the DC PDP has a disadvantage in that it requires a resistor for limiting the current. On the other hand, the alternating current plasma display panel (AC PDP) has electrodes covered with a dielectric layer that naturally forms a capacitance component to limit the current and protects the electrodes from the impact of ions during a discharge. As a result, the AC PDP is superior over the DC PDP in that it has a longer life than the DC PDP.

In an AC PDP, scan electrodes and sustain electrodes covered with a dielectric layer and a protective layer are arranged in pairs in parallel on a first glass substrate. A plurality of address electrodes covered with an insulation layer is arranged on a second glass substrate. Barrier ribs are formed in parallel with the address electrodes on the insulation layer such that each barrier rib is interposed between adjacent address electrodes. A phosphor is coated on the surface of the insulation layer and on both sides of each partition wall. The first and second glass substrates are arranged to face each other while defining a discharge space therebetween so that the address electrodes are orthogonal to the scan electrodes and sustain electrodes. In the discharge space, a discharge cell is formed at an intersection between each address electrode and each pair of scan electrodes and sustain electrodes.

The electrodes of the PDP are arranged in the form of an m×n matrix. In detail, m address electrodes are arranged in a column direction. Also, n scan electrodes and n sustain electrodes are alternately arranged in a row direction.

In general, a process for driving the AC PDP can be expressed by temporal operation periods, i.e., a reset period, an address period and a sustain period.

The reset period is a period in which the state of each cell is initialized so that an addressing operation of each cell is smoothly performed, and the address period is a period in which an address voltage is applied to an addressed cell so as to accumulate wall charges on the addressed cell in order to select a cell to be lighted and a cell not to be lighted in the PDP. The sustain period is a period in which sustain pulses are applied to the addressed cell, thereby performing a discharge according to which a picture is actually displayed.

In the PDP, a gray scale is expressed by dividing one frame (1 TV frame) into a plurality of sub-fields, and performing a time-division operation for the plurality of sub-fields. Each sub-field comprises the reset period, the address period and the sustain period, which have been mentioned above. One frame is divided into 8 sub-fields in order to express 256 gray scales, and each sub-field comprises reset periods, address periods and sustain periods. The sustain periods have lighting periods in a ratio of 1:2:4:8:16:32:64:128.

In the sub-field arrangement, the minimal gray scale which can be implemented is 1, that is, there is a limit to expression of gray scale below 1. If the number of sub-fields is increased so as to generate 512 gray scales for expressing the low gray scale, a problem may arise in that the sustain period is decreased as the address period is increased, which results in low brightness. Accordingly, the above-described methods have problems in expressing the low gray scale (for example, 0.5 or 0.25 gray scale and the like) without increasing the number of sub-fields.

SUMMARY OF THE INVENTION

It is an aspect of the present invention to solve the problems incurred in the related art, and to provide a driving apparatus of a plasma display panel and a method for displaying pictures on the plasma display panel with increased ability to express a low gray scale without increasing the number of sub-fields.

In accordance with one aspect, the present invention provides a driving apparatus of a plasma display panel, comprising:

a peak detector for detecting and transmitting high-order bits not commonly used by picture signal data within one frame of input picture signal data;

an inverse gamma corrector for adding decimal point bits for expression of low gray scales to the input picture signal data for inverse gamma correction, and for shifting the decimal point bits to an actual data position in correspondence to the high order bits detected by the peak detector so as to increase the ability to express the low gray scale; and a sustain number generator for determining the number of sustain pulses according to whether the high order bits are detected by the peak detector.

Preferably, the peak detector extracts picture signal data having the maximal value out of all picture signal data within one frame, and detects the number of unused high order bits from most significant bits in the picture signal data having the maximal value.

In accordance with another aspect, the present invention provides a method for displaying a picture on a plasma display panel, the method including dividing a picture of each frame to be displayed on a plasma display panel into a plurality of sub-fields in correspondence to input picture signal data, and combining brightness weights of the plurality of sub-fields for expressing gray scales, the method further comprising:

detecting high-order bits not commonly used by picture signal data within one frame of the input picture signal data;

adding decimal point bits for expression of low gray scale to the input picture signal data for inverse gamma correction, and shifting the decimal point bits to an actual data position in correspondence to the high order bits detected so as to increase the ability to express the low gray scale; and converting the decimal point bits into sub-fields having low gray scale weights in consideration of the shifting of the decimal point bits to the actual data position.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIGS. 7A thru 7C are diagrams illustrating arrangements and weights of sub-fields determined in the controller according to the embodiment of the present invention.

DETAILED DESCRIPTION OF THE INVENTION

Figure 1:
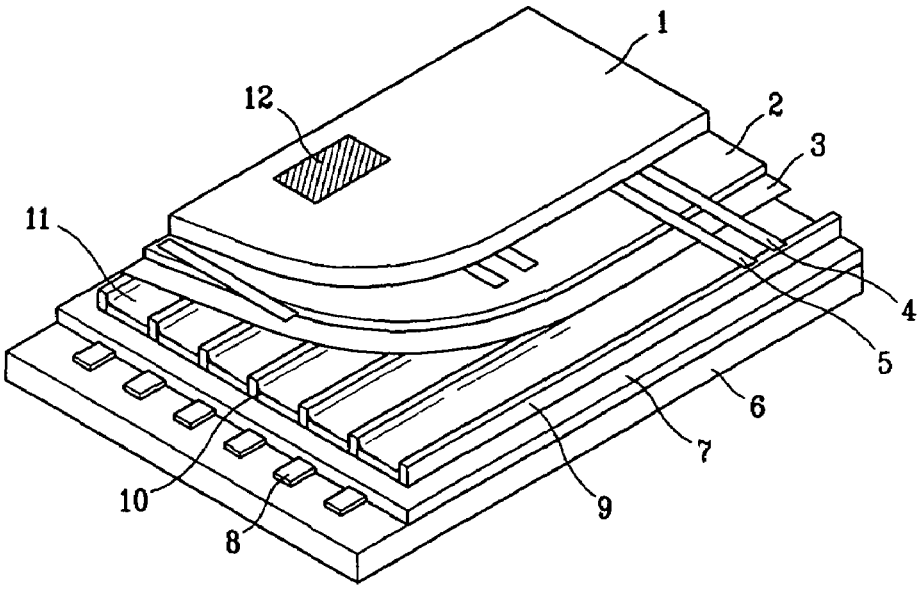
FIG. 1 is a perspective view illustrating a part of an AC PDP.

In the following detailed description, only certain exemplary embodiments of the present invention are shown and described by way of illustration. As those skilled in the art will recognize, the described exemplary embodiments may be modified in various ways, all without departing from the spirit or scope of the present invention. Accordingly, the drawings and description are to be regarded as illustrative in nature, rather than restrictive.

In the drawings, illustrations of elements having no relation with the present invention are omitted in order to prevent the subject matter of the present invention from being unclear. In the specification, the same or similar elements are denoted by the same reference numerals even though they are depicted in different drawings.

A driving apparatus of a PDP and a method for displaying pictures on the PDP according to an embodiment of the present invention will now be described in detail with reference to the drawings.

FIG. 1 is a perspective view illustrating a part of an AC PDP.

Referring to FIG. 1, scan electrodes 4 and sustain electrodes 5 covered with a dielectric layer 2 and a protective layer 3 are arranged in pairs in parallel on a first glass substrate 1. A plurality of address electrodes 8 covered with an insulation layer 7 is arranged on a second glass substrate 6. Barrier ribs 9 are formed in parallel with the address electrodes 8 on the insulation layer 7 such that each barrier rib 9 is interposed between the adjacent address electrodes 8. A phosphor 10 is coated on the surface of the insulation layer 7 and on both sides 8 of each barrier rib 9. The first and second glass substrates 1 and 6 are arranged to face each other while defining a discharge space 11 therebetween so that the address electrodes 8 are orthogonal to the scan electrodes 4 and sustain electrodes 5. In the discharge space, a discharge cell 12 is formed at an intersection between each address electrode 8 and each pair of the scan electrodes 4 and sustain electrodes 5.

Figure 2:
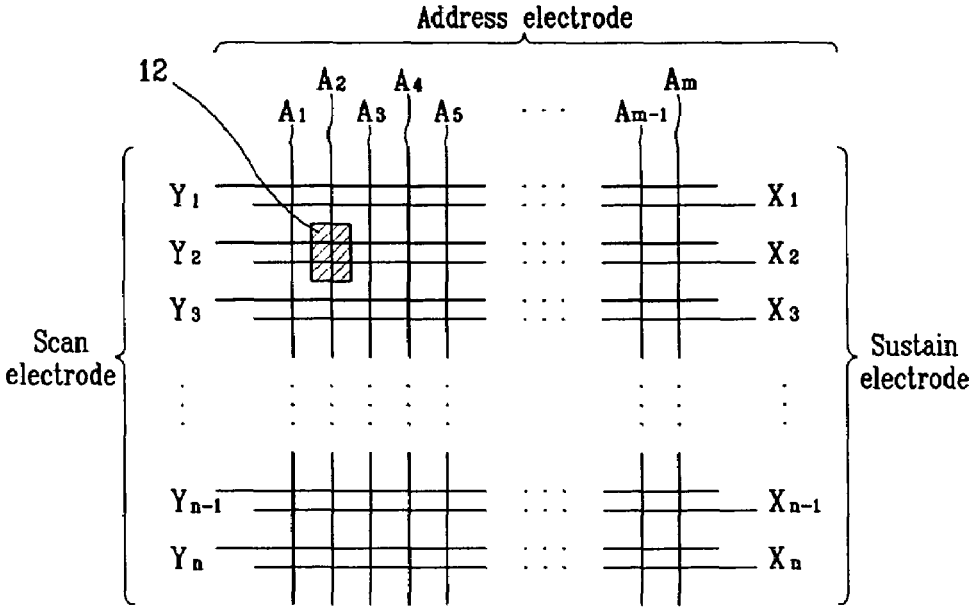
FIG. 2 is a schematic view illustrating an arrangement of electrodes in the PDP.

FIG. 2 shows an arrangement of the electrodes in the PDP.

As shown in FIG. 2, the electrodes of the PDP are arranged in the form of an m×n matrix. In detail, m address electrodes A1 to Am are arranged in a column direction. Also, n scan electrodes Y1 to Yn and n sustain electrodes X1 to Xn are alternately arranged in a row direction. The discharge cell 12 shown in FIG. 2 corresponds to the discharge cell 12 shown in FIG. 1.

In general, a process for driving the AC PDP can be expressed by temporal operation periods, i.e., a reset period, an address period and a sustain period.

The reset period is a period in which the state of each cell is initialized so that an addressing operation of each cell is smoothly performed, and the address period is a period in which an address voltage is applied to an addressed cell so as to accumulate wall charges on the addressed cell in order to select a cell to be lighted and a cell not to be lighted in the PDP. The sustain period is a period in which sustain pulses are applied to the addressed cell, thereby performing a discharge according to which a picture is actually displayed.

Figure 3:
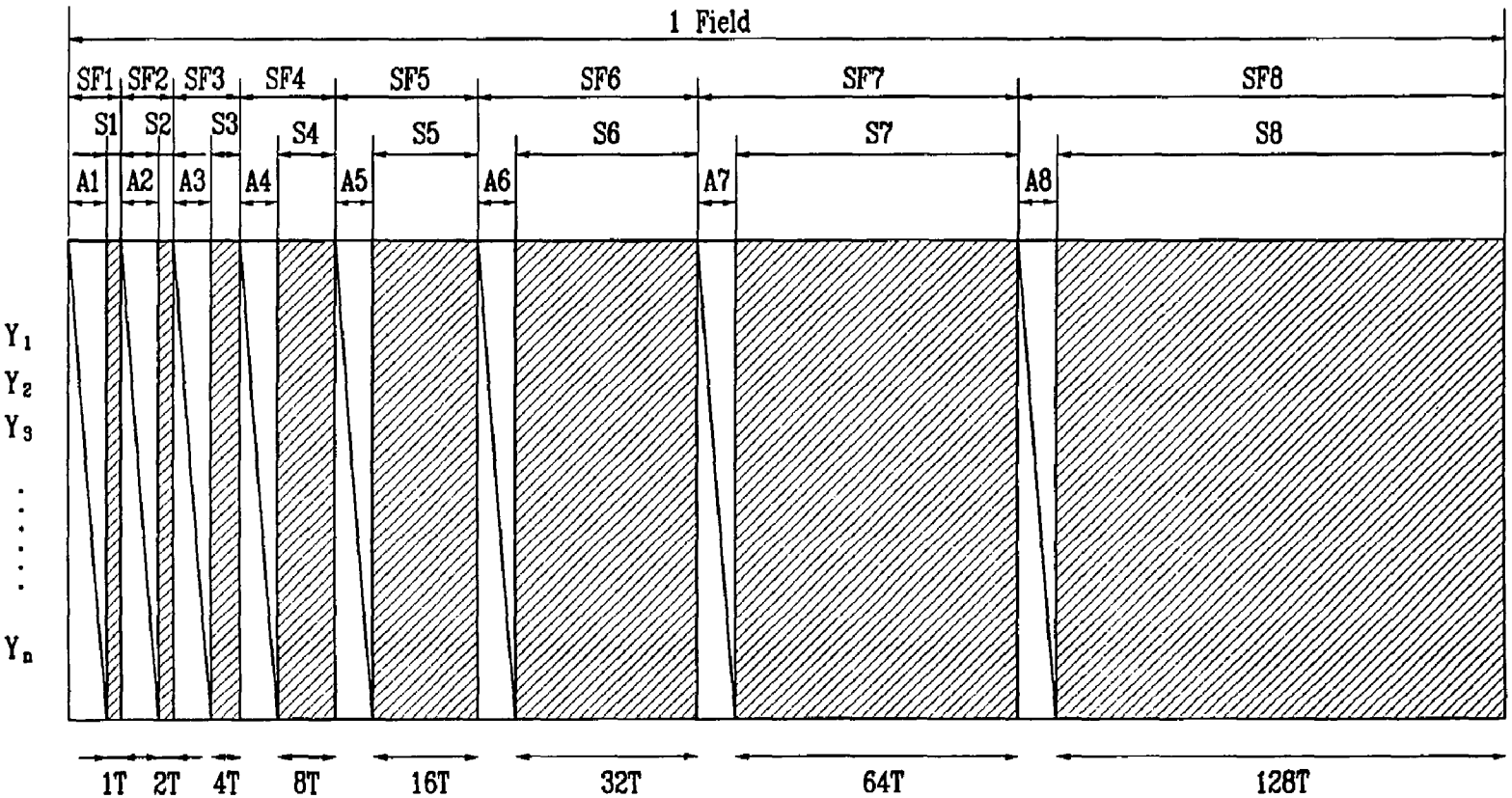
FIG. 3 is a diagram illustrating a method for expressing a gray scale in the plasma display panel.

As shown in FIG. 3, in the PDP, a gray scale is expressed by dividing one frame (1 TV frame) into a plurality of sub-fields, and performing a time-division operation for the plurality of sub-fields. Each sub-field comprises the reset period, the address period and the sustain period, which have been mentioned above. FIG. 3 illustrates one frame divided into 8 sub-fields in order to express 256 gray scales. As shown in the figure, each sub-field (SF1-SF8) comprises reset periods (not shown), address periods (A1-A8) and sustain periods (S1-S8). The sustain periods (S1-S8) have lighting periods (1T, 2T, 4T, . . . , 128T) in a ratio of 1:2:4:8:16:32:64:128. For example, a gray scale of 3 is expressed by discharging a discharge cell during a sub-field having a lighting period of 1T and a sub-field having a lighting period of 3T so as to have a total lighting period of 3T. In this way, a combination of different sub-fields having different lighting periods produces pictures of 256 gray scales.

When input data of one frame of a picture input signal consists of 8 bits, it has values within a range of 0 to 255. Accordingly, input data having values of 127, 63, 31, 15, 7, 3, and 1 use only 7 (lighted in the sub-fields SF1 to SF7), 6, 5, 4, 3, 2 bits and 1 bit, respectively. Residual (unused) bits are filled with "0" (i.e., not lighted in remaining sub-fields).

Corresponding picture information is displayed depending on the number of sustain pulses defined by a level of automatic power control (APC). In other words, the picture information always uses all 8 bits irrespective of values of the picture information. Also, when a maximum value is small, high-order bits play a minor role in being filled with "0".

In the sub-field arrangement as shown in FIG. 3, the minimal gray scale which can be implemented is 1, that is, there is a limit to expression of gray scale below 1. If the number of sub-fields is increased so as to generate 512 gray scales for expressing the low gray scale, a problem may arise in that the sustain period is decreased as the address period is increased, which results in low brightness. Accordingly, the above-described methods have problems in expressing the low gray scale (for example, 0.5 or 0.25 gray scale and the like) without increasing the number of sub-fields.

Figure 4:
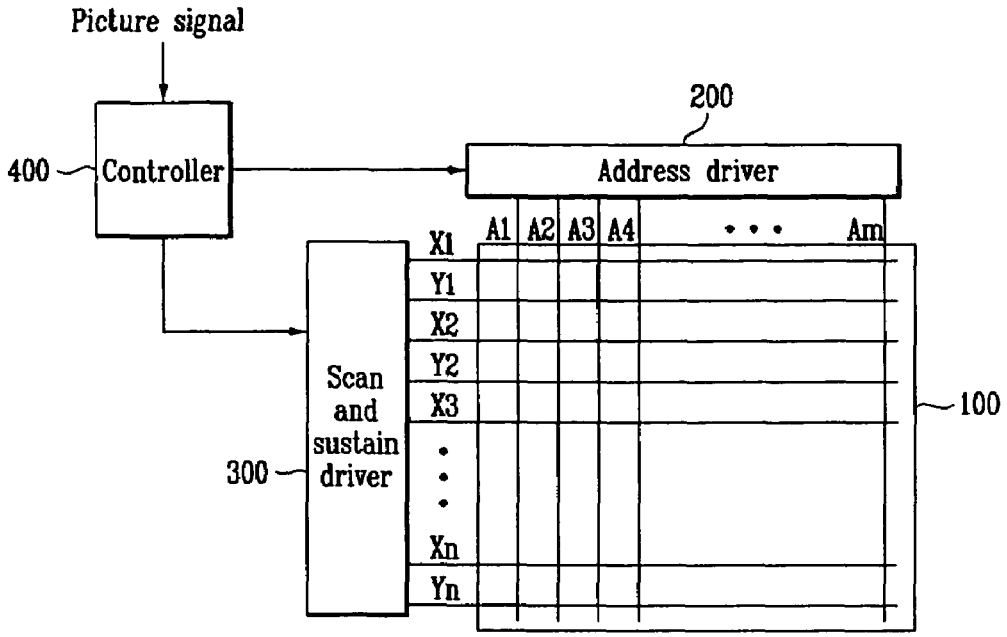
FIG. 4 is a schematic planar view of a plasma display panel according to an embodiment of the present invention.

FIG. 4 is a schematic planar view of the PDP according to an embodiment of the present invention As shown in FIG. 4, the PDP comprises a plasma panel 100, an address driver 200, a scan and sustain driver 300, and a controller 400.

The plasma panel 100 includes a plurality of address electrodes A1 to Am arranged in a column direction, and a plurality of scan electrodes Y1 to Yn and a plurality of sustain electrodes X1 to Xn alternately arranged in a row direction. The address driver 200 receives an address driving control signal from the controller 400, and applies display data signals to respective address electrodes A1 to Am for selecting desired discharge cells. The scan and sustain driver 300 receives a control signal from the controller 400, and alternately applies sustain pulse voltages to the scan electrodes Y1 to Yn and the sustain electrodes X1 to Xn, respectively, thereby causing selected discharge cells to perform a sustained discharge.

The controller 400 externally receives an RGB image signal and a synchronization signal, divides one frame of the RGB image signal into a plurality of sub-fields, and divides each sub-field into a reset period, an address period and a sustain period for driving the PDP. At this time, the controller 400 supplies the address driver 200 and the scan and sustain driver 300 with a required control signal by adjusting the number of sustain pulses to be applied during each sustain period of each sub-field within one frame Hereinafter, the controller 400 according to the embodiment of the present invention will be described in detail with reference to FIGS. 5 thru 7.

Figure 5:
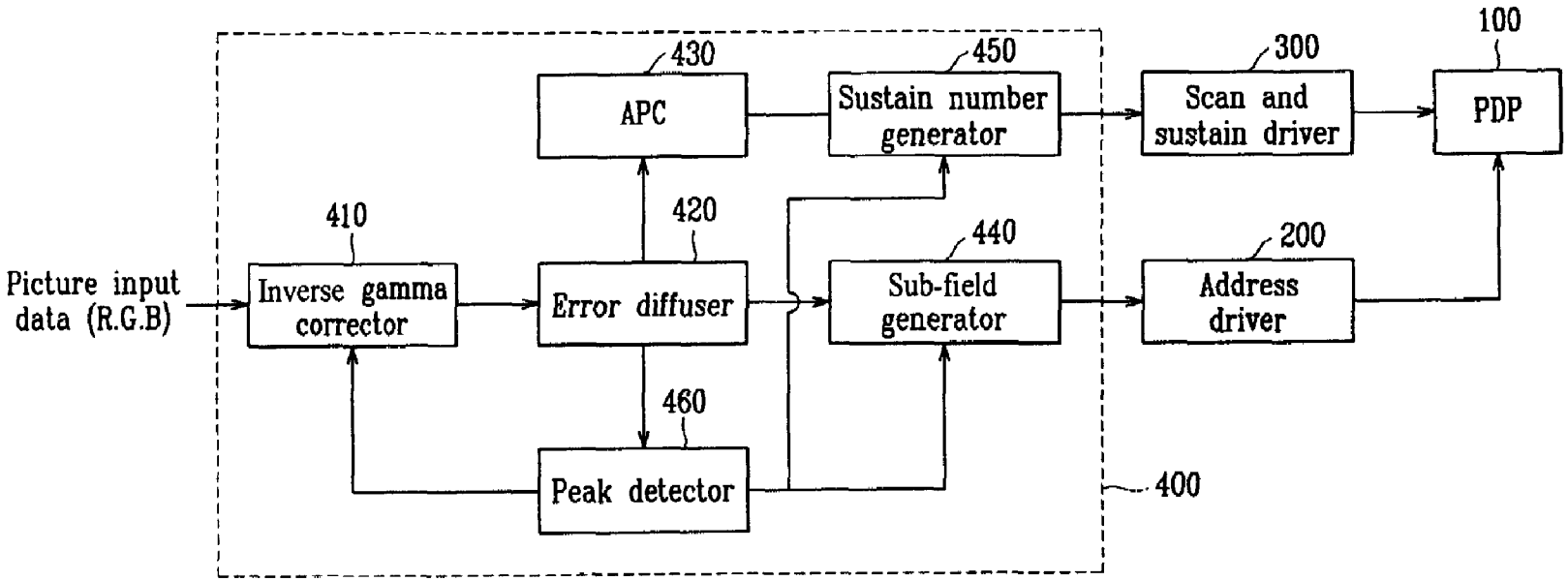
FIG. 5 is a schematic block diagram of a controller of the plasma display panel according to the embodiment of the present invention.
Figure 6:
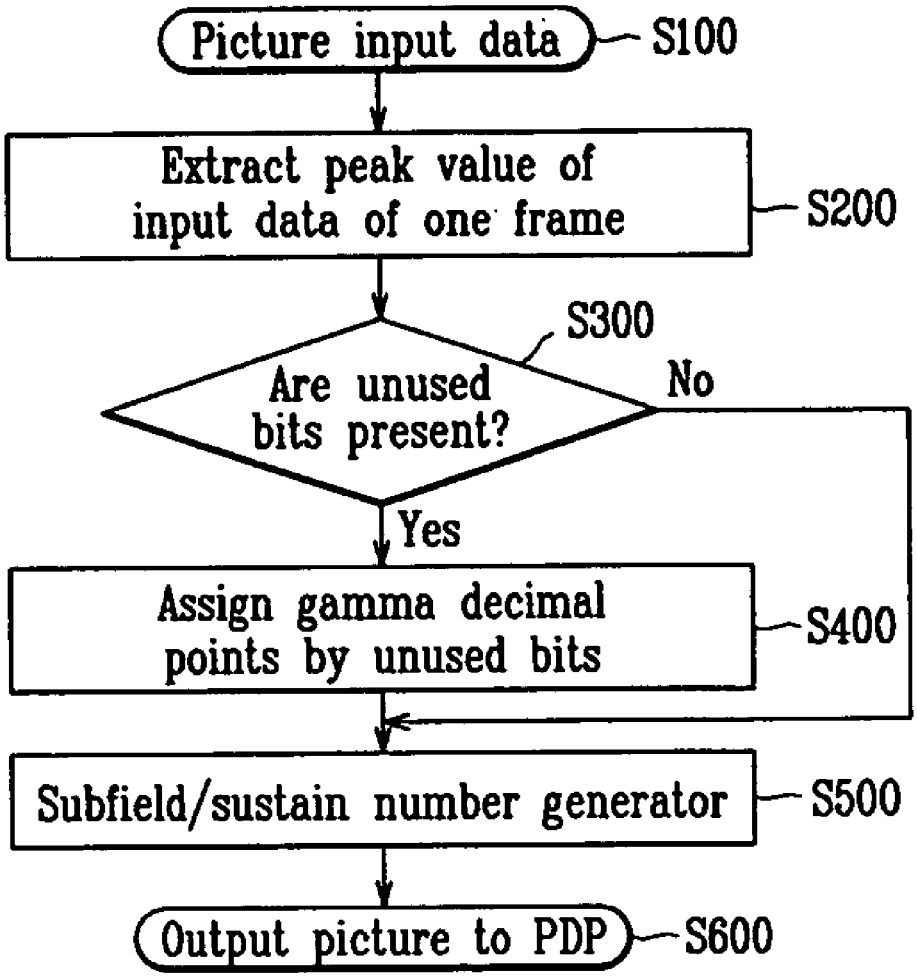
FIG. 6 is a flow chart illustrating a method for displaying pictures on the plasma display panel according to the embodiment of the present invention.

FIG. 5 is a schematic block diagram of a controller of the plasma display panel according to the embodiment of the present invention. FIG. 6 is a flow chart illustrating a method for displaying pictures on the plasma display panel according to the embodiment of the present invention. FIGS. 7A thru 7C are diagrams illustrating arrangements and weights of sub-fields determined in the controller according to the embodiment of the present invention.

As shown in FIG. 5, the controller 400 of the PDP includes an inverse gamma corrector 410, an error diffuser 420, an APC 430, a sub-field generator 440, a sustain number generator 450, and a peak detector 460.

The peak detector 460 extracts a peak value from all picture input data of one frame which is being currently inputted, and detects whether or not unused bits of the most significant bit (MSB) of all input data of one frame are present or not. For this detection, as shown in FIG. 5, the peak detector 460 uses data generated after the picture input data of one frame which is being currently inputted is processed in the inverse gamma corrector 410 and the error diffuser 420. This is because the data which is subject to inverse gamma correction and error diffusion is data most similar to data displayed on the PDP. However, in some cases, the peak detector 460 can use picture input data before inverse gamma correction or picture input data after inverse gamma correction to extract the peak value of all picture input data of one frame, and to detect whether or not unused bits of the MSB of all input data of one frame are present.

At this time, the peak value is obtained by delaying the picture input data by one frame. Since methods for attaining such a delay are apparent to those skilled in the art, detailed explanation thereof will be omitted for the sake of brevity.

As shown in FIG. 7A, if a 63 gray scale is the highest picture input value of all input data of one frame, sub-fields 7 and 8 (SF7 and SF8) are in an off-state, that is, are not used. Accordingly, since unused bits are obtained from data having the highest value, all picture input data values of one frame have at least two unused bits from the MSB. The peak detector 460 detects the number of unused bits and transmits the detected number to the gamma corrector 410, the sub-field generator 440 and the sustain number generator 450. At this time, the peak detector 460 transmits an on/off state of each sub-field to the sub-field generator 440, and transmits a weight of each sub-field to the sustain number generator 450 so as to increase the ability to express the low gray scale.

The inverse gamma corrector 410 corrects the RGB picture input data of n bits, which is being currently inputted, into a picture signal of m bits ($m \geqq n$) by mapping the RGB picture input data on an inverse gamma curve. In general PDPs, n is 8 and m is 10 or 12. The inverse gamma correction by the inverse gamma corrector 410 expands the number of bits. The present invention aims to further increase the ability to express the low gray scale by shifting bits in decimal points, which are subject to inverse gamma correction, to an actual data position. In this case, when the inverse gamma corrector 410 receives from peak detector 460 an indication of the presence of a bit not used by the picture input data within one frame, it shifts the inverse gamma-corrected data to the actual data position by unused bits for increasing the ability to express the low gray scale (See 63 (111111xx.xx) in FIG. 7B). The shifting of the inverse gamma-corrected data can be performed not only in the inverse gamma corrector 410 but also in a separate device interposed between the inverse gamma corrector 410 and the error diffuser 420. As shown in FIG. 7A, if the maximal picture input value of the data within one frame is 63 (when this value is gamma-corrected, the number of bits is expanded as 00111111.xxxx), since two bits from the MSB are not used, the two bits are shifted to the actual data position to increase the ability to express the low gray scale. In addition, as shown in FIG. 7B, if a picture input value is 63, the two unused bits are used to express 0.25 and 0.5 gray scales for expressing the low gray scale.

As the picture signal inputted to the inverse gamma corrector 410 is a digital picture signal, if an analog picture signal is inputted to the PDP, it is necessary to convert the analog picture signal into a digital picture signal by means of an analog to digital converter (not shown). In addition, the inverse gamma corrector 410 can include a look-up table (not shown) for storing data corresponding to the inverse gamma curve for mapping the picture signal or a logic circuit (not shown) for generating data corresponding to the inverse gamma curve through a logical operation.

The error diffuser 420 indicates a picture of low-order m-n bits of m bits, which are inverse gamma-corrected and expanded by the inverse gamma corrector 410, by using an error diffusion or dithering technique. In this case, if the revere gamma-corrected bits are shifted to the actual data position by the unused bits so as to increase the ability to express the low gray scale by means of the inverse gamma corrector 410, the error diffuser 420 performs error-diffusion for a picture of remaining low-order bits except actual data. In other words, if the peak detector 460 determines that two bits from the MSB are not used, the error diffuser 420 performs error diffusion for a picture of low-order m-(n+2) bits, and does not perform error diffusion for the data at a low gray scale portion, which is shifted to the actual data position. The error diffusion is a method of displaying a picture of low-order bits by separating a picture of low-order bits to be error-diffused and diffusing the separated picture toward adjacent pixels, which is described in detail in Korean Patent Laid-Open Publication No. 2002-0014766.

On the other hand, the APC 430 detects a load factor by using picture data outputted from the error diffuser 420, calculates an APC level based on the detected load factor, and calculates a weight multiple corresponding to the calculated APC level.

The sustain number generator 450 outputs a number of sustain pulses by using a weight multiple corresponding to the APC level calculated by the APC 430 and weight values transmitted from the peak detector 460 (that is, weight values of sub-fields for expressing the unused bits by low gray scales, as shown in FIG. 7B). The number of sustain pulses is outputted to the scan and sustain driver 300.

The sub-field generator 440 generates sub-field data by using the picture data outputted from the error diffuser 420 and the on/off state of each sub-field outputted from the peak detector 460. The generated sub-field data is outputted to the address driver 200.

As described above, by using the unused bits to express the low gray scale through the controller 400 according to the embodiment of the present invention, the ability to express the low gray scale can be further increased when a picture is displayed on the PDP.

FIG. 6 is a flow chart illustrating a method for displaying pictures on the PDP according to the embodiment of the present invention.

First, when picture input data is inputted, the peak detector 460 extracts a peak value from all picture input data of one frame (S100, S200). At this time, it is preferable that the peak detector 460 detect the peak value by using values resulting from inverse gamma correction and error diffusion of the picture input data.

Next, based on the detected peak value, it is determined whether all picture input data within one frame have consecutive unused bits from the MSB (S300).

Next, if the unused bits are present, gamma-corrected data are shifted to an actual data position by the unused bits in order to increase the power of expression of low gray scale (S400). In other words, bits corresponding to decimal points of the gamma-corrected data are shifted to the actual position by the unused bits. In this case, the error diffuser 420 performs the error diffusion in consideration of the data shifted to the actual data position.

Next, in consideration of the data shifted to the actual data position by the unused bits in step S400, sub-fields and the corresponding number of sustain pulses are calculated and displayed on the PDP (S500, S600). At this time, weights of sub-fields can be expressed as shown FIG. 7B and FIG. 7C for the purpose of placing a stress on the low gray scale.

On the other hand, if the peak detector 460 detects that unused bits are not present, the picture input data are displayed on the PDP through a conventional process (S300, S500, S600).

At this time, the conventional process is performed under the condition that the picture input data are delayed by one frame.

FIGS. 7A thru 7C are diagrams illustrating arrangements and weights of sub-fields determined in the controller according to the embodiment of the present invention.

FIG. 7A is a diagram illustrating the presence of the unused bits when the maximum picture input value of the data of one frame is 63, from which it is confirmed that two bits (SF7, SF8) from the MSB are not used. The present invention uses these two bits as bits for increasing the ability to express the low gray scale.

FIG. 7B is a diagram illustrating a structure of sub-fields rearranged so as to increase the ability to express the low gray scale when a picture input value is 63, where a weight of SF1 is 0.25, a weight of SF2 is 0.5, and a weight of SF8 is 32. The ability to express the low gray scale can be further increased through such a structure of sub-fields.

FIG. 7C is a diagram illustrating another structure of sub-fields rearranged so as to increase the ability to express the low gray scale when a picture input value is 63, where weights of SF7 and SF8 are 0.25 and 0.5, respectively. As shown in FIG. 7C, it can be seen that the structure of sub-fields is modified by using the unused bits to increase the ability to express the low gray scale according to the present invention. That is, positions of weights in sub-fields to express the low gray scale can be changed.

As is apparent from the above description, by using the unused bits to express the low gray scale according to the present invention, the ability to express the low gray scale can be further increased when a picture is displayed on the PDP.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims.

What is claimed is:

1. A driving apparatus of a plasma display panel, comprising:

a peak detector for detecting and transmitting high-order bits not commonly used by picture signal data within one frame of input picture signal data;

an inverse gamma corrector for adding decimal point bits for expression of low gray scales to the input picture signal data so as to perform inverse gamma correction, and for shifting the decimal point bits to an actual data position in correspondence to the high-order bits detected by the peak detector, so as to increase the ability to express the low gray scales; and a sustain number generator for determining a number of sustain pulses according to whether the high-order bits are detected by the peak detector.

2. The driving apparatus of claim 1, wherein the peak detector extracts picture signal data having a maximum value from picture signal data within one frame, and detects a number of unused high order bits from most significant bits in the picture signal data having the maximum value.

3. The driving apparatus of claim 2, wherein the inverse gamma corrector shifts decimal point bits of inverse gamma-corrected data by the unused high order bits.

4. The driving apparatus of claim 2, further comprising an error diffuser for performing error diffusion for residual low order bits, except low order bits shifted to the actual data position, from among data outputted by the inverse gamma corrector.

5. The driving apparatus of claim 1, wherein the inverse gamma corrector shifts decimal point bits of inverse gamma-corrected data by unused high order bits.

6. The driving apparatus of claim 1, further comprising an error diffuser for performing error diffusion for residual low order bits, except low order bits shifted to the actual data position, from among data outputted by the inverse gamma corrector.

7. A method for displaying a picture on a plasma display panel, the method comprising the steps of:

(a) detecting high-order bits not commonly used by picture signal data within one frame of input picture signal data;

(b) adding decimal point bits for expression of low gray scale to the input picture signal data for inverse gamma correction, and shifting the decimal point bits to an actual data position, in correspondence to the high-order bits detected in step (a) so as to increase ability to express the low gray scale; and (c) converting the decimal point bits into sub-fields having low gray scale weights in consideration of the shifting of the decimal point bits to the actual data position in step (b).

8. The method of claim 7, further comprising the step, after step (b), of performing error diffusion for residual low order bits except low order bits shifted to the actual data position.

9. The method of claim 8, wherein unused high order bits are used to extract picture signal data having a maximum value from picture signal data within one frame and to detect a number of unused high order bits from most significant bits in the picture signal data having the maximum value.

10. The method of claim 7,wherein unused high order bits are used to extract picture signal data having a maximum value from picture signal data within one frame and to detect a number of unused high order bits from most significant bits in the picture signal data having the maximum value.

11. The method of claim 7, wherein a picture of each frame to be displayed on the plasma display panel is divided into a plurality of sub-fields in correspondence to the input picture signal data.

12. The method of claim 7, wherein brightness weights of the plurality of the sub-fields are combined to express gray scales.

13. A method for displaying a picture on a plasma display panel, wherein a picture of each frame to be displayed on the plasma display panel is divided into a plurality of sub-fields in correspondence to input picture signal data, and brightness weights of the plurality of the sub-fields are combined to express gray scales, said method comprising the steps of:

(a) detecting high-order bits not commonly used by picture signal data within one frame of the input picture signal data;

(b) adding decimal point bits for expression of low gray scale to the input picture signal data for inverse gamma correction, and shifting the decimal point bits to an actual data position, in correspondence to the high-order bits detected in step (a) so as to increase the ability to express the low gray scale; and (c) converting the decimal point bits into sub-fields having low gray scale weights in consideration of the shifting of the decimal point bits to the actual data position in step (b).

14. The method of claim 13, further comprising the step, after step (b), of performing error diffusion for residual low order bits except low order bits shifted to the actual data position.

15. The method of claim 14, wherein unused high-order bits are used to extract picture signal data having a maximum value from picture signal data within one frame and to detect a number of unused high order bits from most significant bits in the picture signal data having the maximum value.

16. The method of claim 13, wherein unused high-order bits are used to extract picture signal data having a maximum value from picture signal data within one frame and to detect a number of unused high order bits from most significant bits in the picture signal data having the maximum value.

* * * * *